US008047873B1

(12) United States Patent
Wang

(10) Patent No.: US 8,047,873 B1
(45) Date of Patent: Nov. 1, 2011

(54) WATERPROOF ELECTRIC PLUG WITH TRANSFORMER

(75) Inventor: Sheng Lien Wang, Hsinchu County (TW)

(73) Assignee: Ting Shen Industrial Co., Ltd., Hsinchu (TW)

( * ) Notice: Subject to any disclaimer, the term of this patent is extended or adjusted under 35 U.S.C. 154(b) by 0 days.

(21) Appl. No.: 12/805,573

(22) Filed: Aug. 6, 2010

(51) Int. Cl.
*H01R 13/40* (2006.01)

(52) U.S. Cl. ..... 439/589

(58) Field of Classification Search ..... 439/76.1, 439/620.22, 587, 650, 589; 336/107; 320/111
See application file for complete search history.

(56) References Cited

U.S. PATENT DOCUMENTS

| | | | | |
|---|---|---|---|---|
| 6,309,225 | B2 * | 10/2001 | Kameyama | 439/76.1 |
| 7,002,808 | B2 * | 2/2006 | Lim et al. | 361/752 |
| 7,766,681 | B1 * | 8/2010 | Wang | 439/276 |
| 7,862,380 | B1 * | 1/2011 | Wang | 439/620.22 |
| 7,896,702 | B2 * | 3/2011 | Stiehl et al. | 439/620.22 |

* cited by examiner

*Primary Examiner* — Phuong Dinh
(74) *Attorney, Agent, or Firm* — Bacon & Thomas, PLLC

(57) ABSTRACT

A waterproof electric plug with transformer includes a housing comprising an internal space, two forward prongs, a rear waterproof element, and a rear fastening assembly; a transformer unit disposed in the space and electrically connected to the prongs; a rear cap comprising a connector electrically connected to the transformer unit, and a corresponding fastening assembly; and a waterproof member disposed in the waterproof element. The housing is adapted to repel water when the cap is secured thereto by matingly fastening the corresponding fastening assembly and the fastening assembly together with the waterproof member being clamped in the waterproof element.

3 Claims, 5 Drawing Sheets

WATERPROOF ELECTRIC PLUG WITH TRANSFORMER

BACKGROUND OF THE INVENTION

1. Field of Invention

The invention relates to electric plugs and more particularly to an improved waterproof electric plug having a transformer.

2. Description of Related Art

Alternating current (AC) power is required to transform into direct current (DC) power prior to supplying to small electric/electronic products such as mobile phones, lamps, Christmas lamp strings, etc. For example, plugs of Christmas lamp strings are required to be waterproof because in often times they are used outsides. Rain, water, and moisture may enter plugs that are not waterproof when the plugs are used outsides. This can cause short circuit to the plugs.

However, many types of waterproof electric plugs having a transformer for Christmas lamp strings have complicated components and poor quality. U.S. Pat. No. 7,140,920 discloses an electric plug comprising two forward prongs, two rear slots, two conductive wires having one end disposed in the housing, and an internal resistor electrically interconnecting the prongs and the wires. However, such configured plugs are not waterproof. Moreover, the components are relatively complicated.

Another conventional waterproof electric plug comprises a transformer in a housing, and a rear cover sealed the housing. Moreover, plastic are molded onto the housing and the seal to form a waterproof construction. However, its production cost is prohibitively high and its assembly is complicated and time consuming. Thus, the need for improvement still exists.

SUMMARY OF THE INVENTION

It is therefore one object of the invention to provide a waterproof electric plug with a transformer having the advantages including quick, simple, and easy assembly due to snapping coupling arrangement, low production cost, and reliable quality waterproof arrangement in the joining portion of cap and housing so as to prevent rain, water, and moisture from entering the housing.

For achieving above and other objects of the invention, there is provided an electric plug comprising a housing comprising an internal space, two forward prongs, a rear waterproof element, and a rear fastening assembly; a transforming unit disposed in the space and electrically connected to the prongs; a rear cap comprising a connector electrically connected to the transforming unit, and a corresponding fastening assembly; and a waterproof member disposed in the waterproof element, wherein the housing is adapted to repel water when the cap is secured thereto by matingly fastening the corresponding fastening assembly and the fastening assembly together with the waterproof member being clamped in the waterproof element.

In one aspect of the invention the waterproof element is a closed groove, the waterproof member is formed of elastomeric material and is shaped as a closed loop matingly fitted into the groove, and the cap further comprises a periphery projecting member matingly fitted in the groove to fasten the waterproof member in the groove.

In another aspect of the invention the fastening assembly comprises at least one slot and the corresponding fastening assembly comprises at least one tab, the number of the tab being equal to that of the slot and each tab being adapted to lockingly insert into the corresponding slot.

The above and other objects, features and advantages of the invention will become apparent from the following detailed description taken with the accompanying drawings.

DETAILED DESCRIPTION OF THE INVENTION

Figure 1:
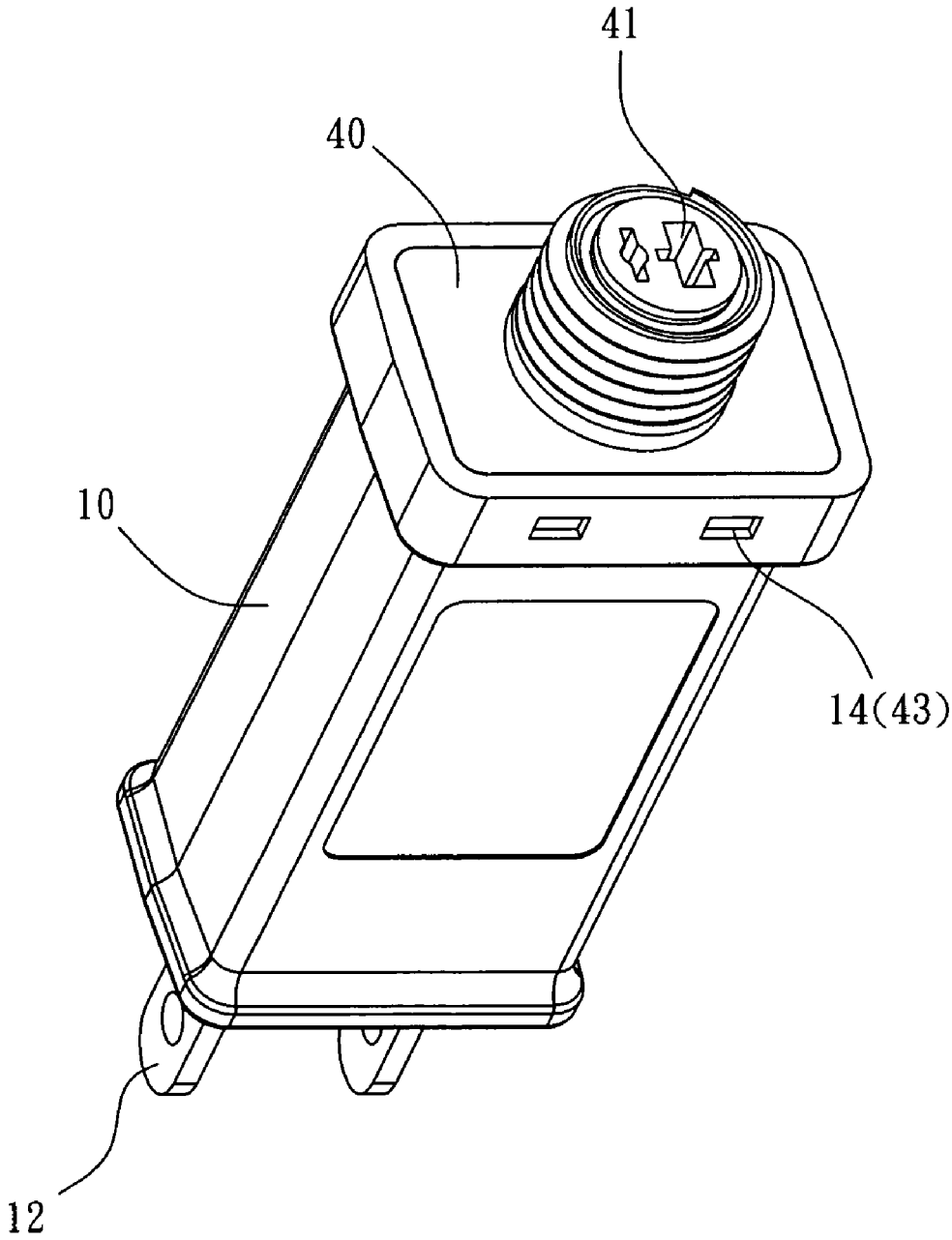
FIG. 1 is a perspective view of a waterproof electric plug according to the invention.
Figure 2:
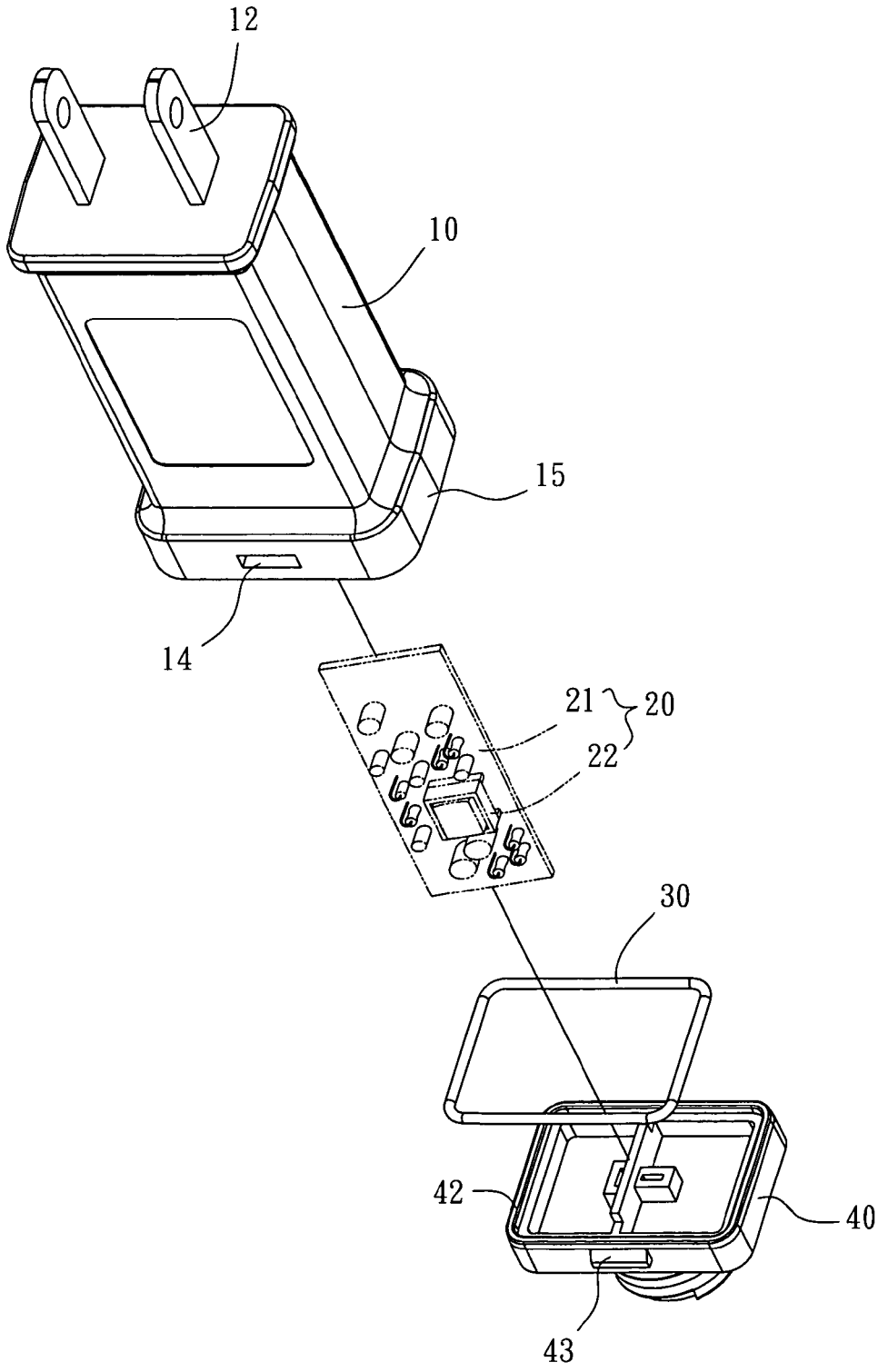
FIG. 2 is an exploded view of the waterproof electric plug.
Figure 3:
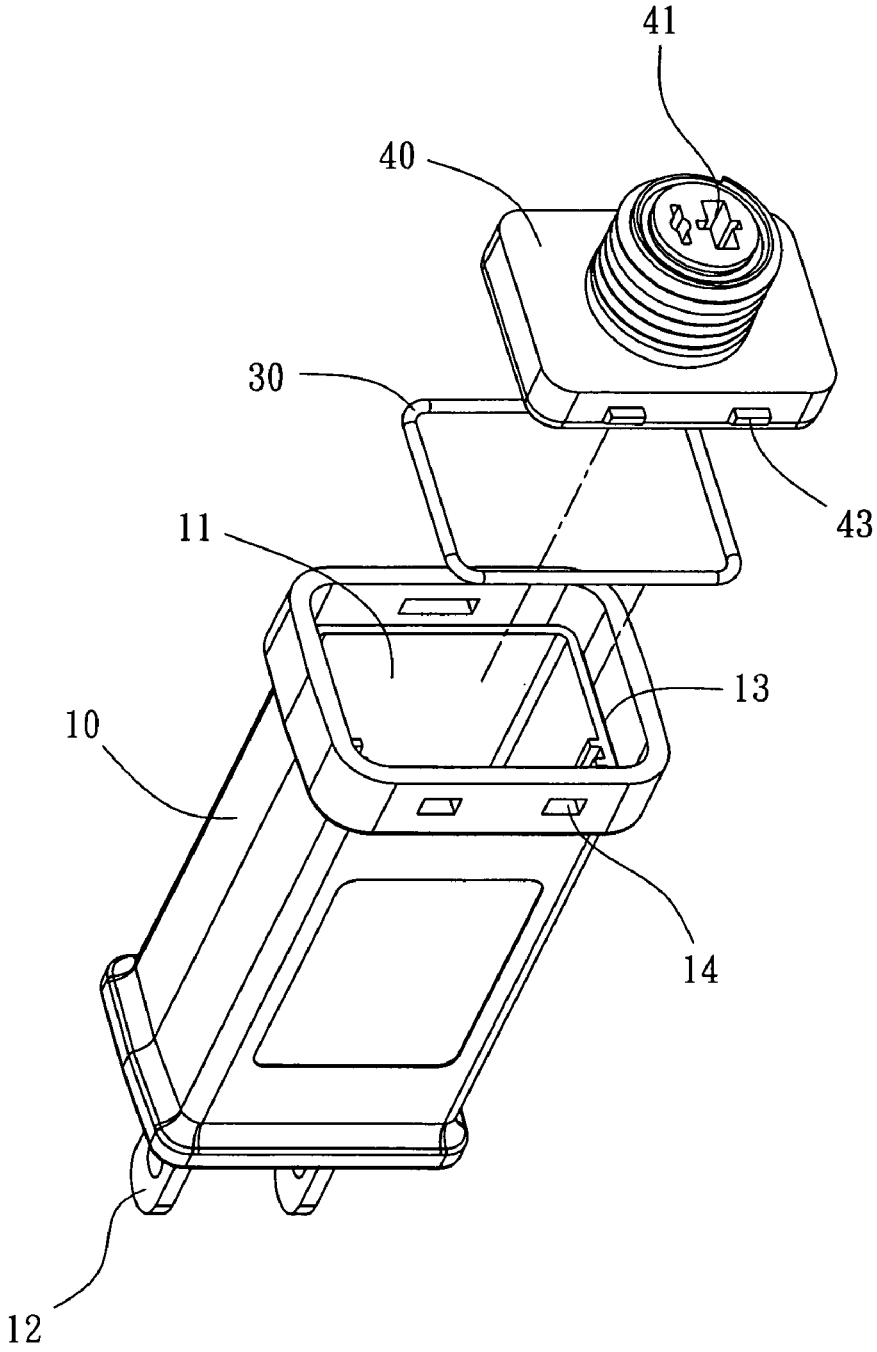
FIG. 3 is another exploded view of the waterproof electric plug.
Figure 4:
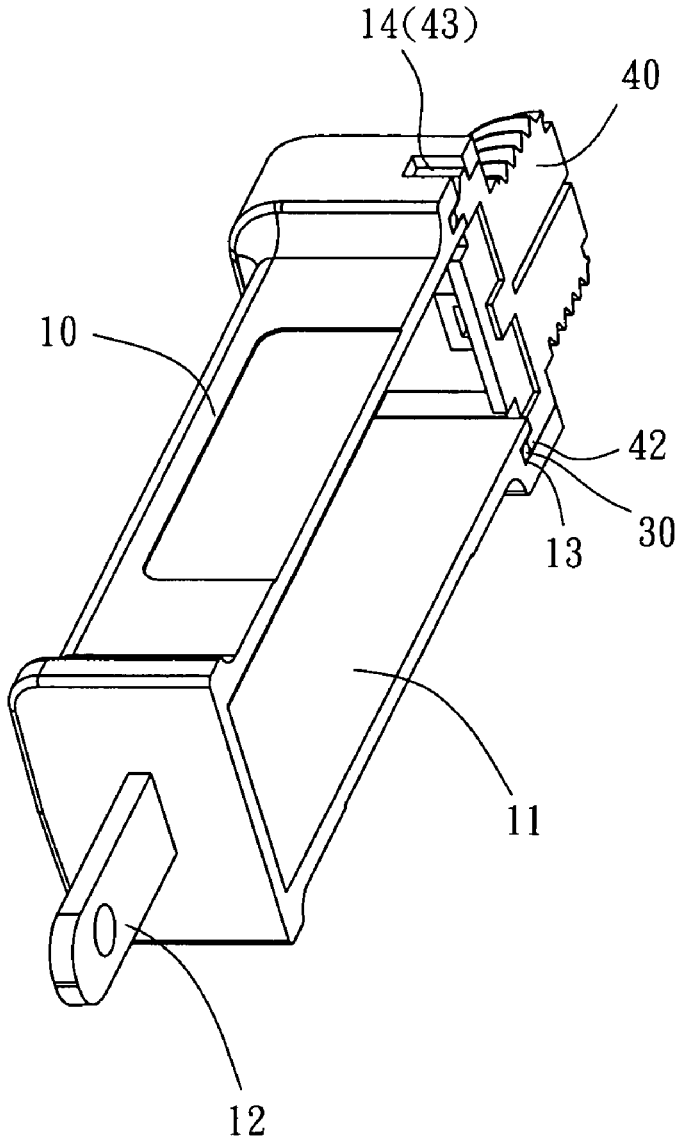
FIG. 4 is a broken-away perspective view of the waterproof electric plug.
Figure 5:
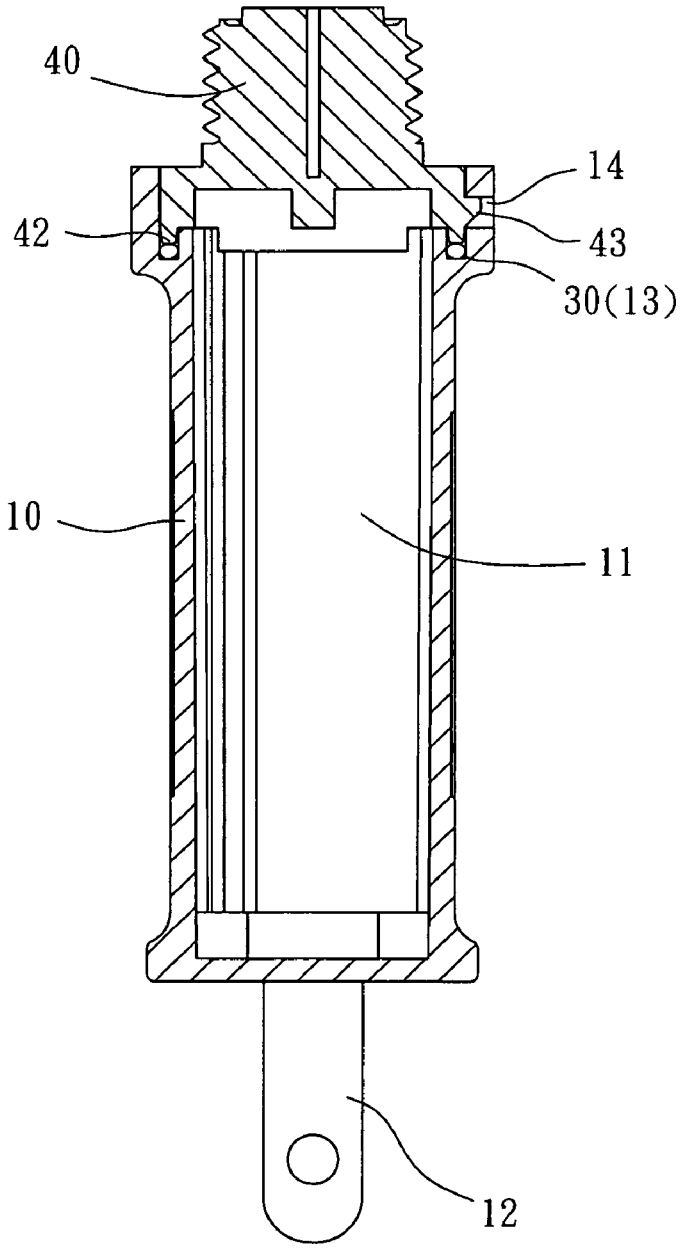
FIG. 5 is a longitudinal sectional view of the waterproof electric plug.

Referring to FIGS. 1 to 5, a waterproof electric plug in accordance with the invention comprises a housing 10, a transformer unit 20, a waterproof member 30, and a rear cap 40. Each component will be discussed in detail below.

The housing 10 is a rectangular, hollow body and comprises an internal space 11 for mounting the transformer unit 20, a pair of forward prongs 12, a closed groove 13 adjacent to the rear end of the housing 10, a rear periphery flange 15, and three slots 14 in which one slot 14 is on one of four sides of the flange 15 and two slots 14 are on the other opposite side of the flange 15.

The transformer unit 20 is disposed in the space 11 and comprises a printed circuit board (PCB) 21 electrically connected to the prongs 12, and a transformer 22 on the PCB 21. The transformer unit 20 can convert AC to DC as known in the art.

The waterproof member 30 is made of elastomeric material and is shaped as a rectangular loop. The waterproof member 30 is fitted into the groove 13.

The cap 40 is rectangular and comprises an externally threaded connector 41 projecting rearward and having one end electrically connected to the transformer unit 20 and the other end adapted to electrically connect to a plug of a power cord (not shown), a periphery projecting member 42 shaped to fit in the groove 13 to fasten the waterproof member 30 in the groove 13, and three tabs 43 in which one tab 43 is on one of four sides of the cap 40 and two tabs 43 are on the other opposite side of the cap 40. The tabs 43 are snappingly inserted into the corresponding slots 14 to secure the cap 40 to the rear end (i.e., the flange 15) of the housing 10. As a result, the coupling of the cap 40 and the housing 10 is waterproof.

The invention has the following advantages: The assembly of the cap 40 and the housing 10 is quick, simple, and reliable due to the snapping coupling operation. Moreover, the waterproof member 30 mounted in the joining portion of the cap 40 and the housing 10 can provide a high quality waterproof coupling. Hence, rain, water, and moisture are prevented from entering the space 11 through the rear end of the housing 10.

While the invention has been described in terms of preferred embodiments, those skilled in the art will recognize that the invention can be practiced with modifications within the spirit and scope of the appended claims.

What is claimed is:

1. An electric plug comprising:

a housing comprising an internal space, two forward prongs, a rear waterproof element, and a rear fastening assembly;

a transformer unit disposed in the space and electrically connected to the prongs;

a rear cap comprising a connector electrically connected to the transformer unit, a corresponding fastening assembly, and a periphery projecting member protruding from a peripheral edge portion of the rear cap; and a waterproof member disposed in the waterproof element, the waterproof element being a closed groove formed in the housing, wherein the housing is adapted to repel water when the cap is secured thereto by matingly fastening the corresponding fastening assembly and the rear fastening assembly together such that the waterproof member is clamped in the waterproof element by the periphery projecting member which extends into the closed groove.

2. The electric plug of claim 1, wherein the waterproof member is formed of elastomeric material and is shaped as a closed loop matingly fitted into the groove.

3. The electric plug of claim 1, wherein the fastening assembly comprises at least one slot and the corresponding fastening assembly comprises at least one tab, the number of the tab being equal to that of the slot and each tab being adapted to lockingly insert into the corresponding slot.

* * * * *